US009611577B1

(12) United States Patent
Yi

(10) Patent No.: US 9,611,577 B1
(45) Date of Patent: Apr. 4, 2017

(54) DRY CLEANING SYSTEMS AND METHODS

(71) Applicant: CLEANLAND, LLC, Kenilworth, NJ (US)

(72) Inventor: Chong Tae Yi, Ridgefield, NJ (US)

(73) Assignee: Cleanland, LLC, Kenilworth, NJ (US)

( * ) Notice: Subject to any disclaimer, the term of this patent is extended or adjusted under 35 U.S.C. 154(b) by 0 days.

(21) Appl. No.: 14/968,733

(22) Filed: Dec. 14, 2015

Related U.S. Application Data

(60) Provisional application No. 62/259,042, filed on Nov. 23, 2015.

(51) Int. Cl.

| | |
|---|---|
| ***D06F 43/00*** | (2006.01) |
| ***D06F 35/00*** | (2006.01) |
| ***D06F 25/00*** | (2006.01) |
| ***D06F 43/02*** | (2006.01) |

(52) U.S. Cl.
CPC ..... *D06F 25/00* (2013.01); *D06F 35/005* (2013.01); *D06F 35/007* (2013.01); *D06F 43/007* (2013.01); *D06F 43/02* (2013.01)

(58) Field of Classification Search
CPC ..... D06F 25/00; D06F 35/005; D06F 35/007; D06F 39/04; D06F 43/007; D06F 43/02; D06F 58/28
See application file for complete search history.

(56) References Cited

U.S. PATENT DOCUMENTS 3,089,327 A * 5/1963 Stilwell, Jr. ..... D06F 29/02 68/139
3,301,024 A * 1/1967 Smith ..... D06F 33/02 34/527
3,771,334 A 11/1973 Quackenbush
4,154,002 A 5/1979 Moore
5,327,751 A 7/1994 Biagi
5,942,007 A 8/1999 Berndt et al.
7,300,468 B2 * 11/2007 Wright ..... D06F 35/006 510/280
7,497,877 B2 3/2009 Goedhart et al.
7,534,304 B2 * 5/2009 Conrad ..... C11D 11/0064 134/10

(Continued)

OTHER PUBLICATIONS

Firbimatic, "Another Breakthrough from a World Leader in State of the Art Engineering and Technology—The Next Generation of Machines Using Soft Mount Basket Technology—EcoPro" (publication date prior to 2010).

(Continued)

*Primary Examiner* — Joseph L Perrin
(74) *Attorney, Agent, or Firm* — Greenberg Traurig, LLP

(57) ABSTRACT

The present invention provides a method for cleaning fabric articles which comprises the steps of: washing the fabric articles with a cleaning solvent in a rotatable drum; rotating the drum at a high spin speed for a high spin period of time after the performance of said washing step; and heating the fabric articles for at least a period of time during the performance of said rotating step. During the heating step, at least some of the cleaning solvent is removed from the fabric articles in both liquid and vapor phases. Heating the fabric articles decreases attractive forces between the liquid phase cleaning solvent and the fabric articles, facilitating the separation and hence removal of additional quantities of the cleaning solvent from the fabric articles.

15 Claims, 3 Drawing Sheets

(56) References Cited

U.S. PATENT DOCUMENTS

| | | | | |
|---|---|---|---|---|
| 7,695,524 | B2 * | 4/2010 | Wright | D06F 43/085 8/137 |
| 7,837,741 | B2 | 11/2010 | Kerpels et al. | |
| 7,966,684 | B2 | 6/2011 | Wright et al. | |
| 8,607,595 | B2 * | 12/2013 | Besikci | D06F 35/007 68/12.12 |
| 2005/0155393 | A1 * | 7/2005 | Wright | D06F 43/00 68/3 R |
| 2006/0260065 | A1 * | 11/2006 | Wright | D06F 35/006 8/158 |
| 2008/0148785 | A1 * | 6/2008 | Lee | D06F 37/20 68/140 |

OTHER PUBLICATIONS

Firbimatic, "Axial Series" (publication date prior to 2010).
Firbimatic, "Another Breakthrough From a World Leader in State of the Art Engineering and Technology—The Next Generation of Perc Machines—Vortex" (publication date prior to 2010).
Firbimatic, "Machine and Manufacturer Details Manual", (publication dates in or about 2003-2006).

* cited by examiner

DRY CLEANING SYSTEMS AND METHODS

CROSS-REFERENCE TO RELATED APPLICATION

The present application is a Section 111(a) application relating to and claiming the benefit, under 35 U.S.C. §119 (e), of commonly owned, U.S. Provisional Patent Application No. 62/259,042, filed on Nov. 23, 2015, the disclosure of which is incorporated herein by reference in its entirety.

FIELD OF THE INVENTION

The present invention relates to systems and methods for cleaning fabric articles.

BACKGROUND OF THE INVENTION

"Dry cleaning" is a term generally used to describe methods for cleaning fabric articles that employ one or more non-aqueous cleaning solvents. Thus, in this context "dry" means cleaning without water. Different non-aqueous cleaning solvents have historically been used for dry cleaning processes including petroleum derived solvents (e.g., gasoline and kerosene) and chlorinated hydrocarbons (e.g., trichloroethylene (TCE) and perchloroethylene (perc)) solvents, as well as the more-recently introduced brominated solvents, glycol ethers, siloxane based solvents and supercritical $CO_2$. Dry cleaning methods are typically performed in a vessel or drum that can be agitated, such as by rotation.

SUMMARY OF THE INVENTION

The present invention provides a method for cleaning fabric articles which comprises the steps of: washing the fabric articles with a cleaning solvent in a rotatable drum; rotating the drum at a high spin speed for a high spin period of time after the performance of said washing step; and heating the fabric articles for at least a period of time during the performance of the rotating step. The cleaning solvent may comprise an aqueous solvent or a non-aqueous dry cleaning solvent. In some embodiments, for example, the high spin speed is within a range from about 350 revolutions per minute to about 1200 revolutions per minute. In some embodiments, for example, the high spin period of time is within a range from about 0.5 minute to about 10 minutes.

During the heating step, at least some of the cleaning solvent is removed from the fabric articles in both liquid and vapor phases. Heating the fabric articles decreases attractive forces between the liquid phase cleaning solvent and the fabric articles, facilitating the separation and hence removal of at least some of the liquid phase cleaning solvent from the fabric articles.

In an exemplary embodiment, the heating step is performed by adding a heated gas to the drum, for example a heated gas having a temperature within a range from about 70 degrees Fahrenheit to about 200 degrees Fahrenheit. While rotating the drum at the high spin speed centrifugal forces are created causing the fabric articles to be radially pressed against a wall of the drum during rotation of the drum, causing at least a first portion of the liquid phase cleaning solvent in the fabric articles to flow in a radially outward direction from an interior of the drum to an exterior of the drum. The centrifugal forces cause the heated gas to flow in the radially outward direction through the fabric articles from the interior of the drum to the exterior of the drum, causing at least a second portion of the liquid phase cleaning solvent in the fabric articles to evaporate into vapors, the centrifugal forces causing the vapors to flow in the radially outward direction from the fabric articles to the exterior of the drum.

In some exemplary embodiments, the method may further comprise the step of performing a tumble spin period by rotating the drum at a tumbling speed for a tumble period of time, either before or after the performance of the rotating step, or both before and after the performance of the rotating step.

In an exemplary embodiment of the method of the present invention, the tumble spin period may be performed after the performance of the rotating step, and the method may further comprise the steps of performing a second rotating step by rotating the drum at a second high spin speed for a second high spin period of time after the performance of the tumble spin period while heating the fabric articles for at least a second period of time during the performance of said second rotating step.

In another exemplary embodiment of the method of the present invention, the tumble spin period may be performed before and after the performance of the rotating step, and the method may further comprise the steps of performing a second rotating step by rotating the drum at a second high spin speed for a second high spin period of time after the performance of the tumble spin period while heating the fabric articles for at least a second period of time; and also performing another tumble spin period after the performance of the second rotating step.

In some exemplary embodiments, the method may further comprise the step of performing a low spin period by rotating the drum at a low spin speed for a low spin period of time, after the performance of the washing step, and before or after the performance of the rotating step, or both before and after the performance of the rotating step.

The present invention also provides an apparatus for cleaning fabric articles and which comprises a rotatable drum sized and shaped so as to receive the fabric articles such that the fabric articles can be washed with a cleaning solvent in said drum. The drum is rotatable at a high spin speed for a high spin period of time after the washing of the fabric articles. The drum is also configured to heat the fabric articles for at least a period of time while the drum is being rotated at the high spin speed. The drum may also be configured to receive a heated gas while the drum is being rotated at the high spin speed.

BRIEF DESCRIPTION OF THE DRAWINGS

For a more complete understanding of the present invention, reference is made to the following detailed description of exemplary embodiments considered in conjunction with the accompanying drawings, in which like structures are referred to by like numerals throughout the several views, and in which.

DETAILED DESCRIPTION OF THE INVENTION

The fabric cleaning systems and methods of the present invention clean fabric articles by removing soil and other contaminants from the fabric articles using a cleaning solvent. The cleaning solvent may be an aqueous solvent comprising up to 100% water, by weight, or a non-aqueous dry cleaning solvent. Exemplary embodiments of the methods and systems of the present invention will now be described in connection with dry cleaning and use of non-aqueous dry cleaning solvents. Nonetheless, it should be understood that the following detailed description is equally applicable to methods and systems for cleaning fabric articles that employ aqueous cleaning solvents, including those which comprise up to 100% water, by weight.

The cleaning methods according to the present invention may be performed using any cleaning machine and/or system equipped with a rotatable drum having an interior chamber for holding the fabric articles and cleaning solvent therein. Suitable cleaning machines and/or systems are not particularly limited and include any machines and/or systems, known now or in the future, for cleaning fabric articles using a cleaning solvent, whether aqueous or non-aqueous. More particularly, various dry cleaning machines and/or systems are generally known and described in detail, for example, in U.S. Pat. Nos. 3,771,334, 4,154,002 and 5,327,751, the disclosures of each of which are incorporated herein by reference in their entireties. Additionally, a particular suitable dry cleaning machine and/or system is the Model iQ500 which is commercially available from S & B Machinery located in Norristown, Pa., U.S.A.

Figure 1:
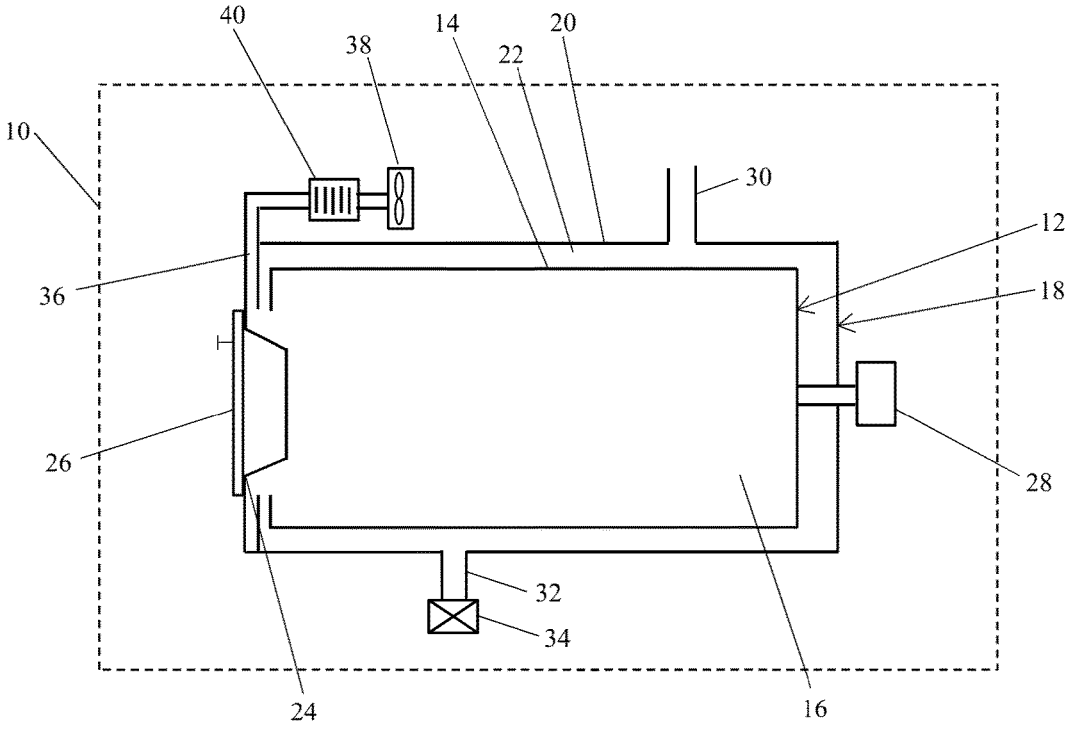
FIG. 1 is a schematic side view of a dry cleaning system having a rotatable cylindrical drum and being useful for performing the dry cleaning methods of the present invention.
Figure 2:
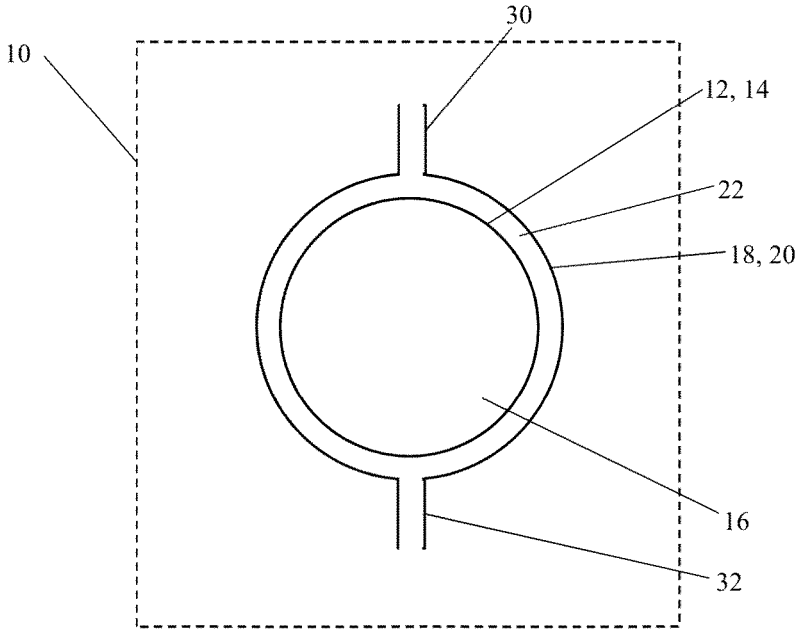
FIG. 2 is a schematic end view of the rotatable cylindrical drum and housing of FIG. 1.

A schematic representation of a suitable dry cleaning system or apparatus 10 is provided in FIGS. 1 and 2. The dry cleaning system or apparatus 10 includes at least a cylindrical rotatable drum 12 having a wall 14 that forms a chamber 16 for holding fabric articles and dry cleaning solvent therein. The rotatable drum 12 is supported in a drum housing 18 which has a solid wall 20 enclosing a fluid zone 22 around the rotatable drum 12. The wall 14 of the drum 12 has perforations (not shown per se) for allowing fluids such as dry cleaning solvent and air to flow from the chamber 16 to the fluid zone 22.

As shown particularly in FIG. 1, an opening 24 is provided through the housing 14 and drum 12 for placing fabric articles in and removing them from the chamber 16. A door 26 sealably covers the opening 24 when the dry cleaning apparatus 10 is in use. A motor 28 is connected to the drum 12 for rotating the drum 12 within the housing 18. FIG. 2 shows the placement of the drum 12 and housing 18 whereby rotation of the drum 12 is possible. The housing 18 has vapor and liquid outlets 30, 32, respectively, each of which is in communication with the fluid zone 22. As will be discussed hereinafter, air and vapor phase dry cleaning solvent (not shown) exit the fluid zone 22 through the vapor outlet 30. The liquid outlet 32 allows liquid phase dry cleaning solvent to drain out of the fluid zone 22 when an associated valve 34 (see FIG. 1) is in an open position. Dry cleaning solvent is retained in the chamber 16 and fluid zone 22 when the valve 34 is in a closed position.

With reference to FIG. 1, the dry cleaning system 10 further includes an inlet passage 36 which is in fluid communication with the chamber 16. A fan or impeller 38 is positioned in the inlet passage 36 for directing air (or other suitable gases) into the chamber 16 of the rotatable drum 12. A heater 40, such as a coil heater or heat exchanger, is also positioned in the air inlet passage 36 for heating the air supplied to the chamber 16 by the fan 38.

Although not shown in FIGS. 1 and 2, the dry cleaning apparatus 10 typically also includes various other conventional components, such as additional inlets and outlets, conduits, reservoir and collection vessels (for fresh and spent fluids), motors (e.g., for rotating the drum), heat exchangers (for heating and cooling fluids), pumps and fans (for causing fluids to flow), and electric and electronic circuits and connectors, for enabling operation of the dry cleaning system 10. Moreover, although not required or shown per se in FIGS. 1 and 2, the dry cleaning system 10 may include, or be programmably and operably connected, to a computer having various components including input/output devices, memory storage and a programmable processor that can be programmed to operate the dry cleaning system 10 to perform various functions and cycles for predetermined periods of time under predetermined conditions.

With reference to the flow charts provided in FIGS. 3 and 4, the dry cleaning method 100 of the present invention will now be described. Reference will also be made hereinafter to FIGS. 5 and 6 which show the flow of fluids in the dry cleaning system 10 described above. Generally, the dry cleaning method 100 involves performing a washing cycle 110, followed by a draining cycle 120, adding heated air 130, and performing an extracting/drying cycle 140 which includes at least one high spin cycle (see, e.g., high spin cycle 144 shown in FIG. 4) and is followed by tumble drying 150 and cool down 160 cycles. More particularly, the washing cycle 110 is performed by contacting fabric articles 48 (see FIGS. 5 and 6) having soil and other contaminants thereon with a dry cleaning solvent to produce washed fabric articles and spent dry cleaning solvent (i.e., that contains soil and other contaminants).

The washing cycle 110 may be performed with or without rotating the drum 12. Rotating the drum 12 increases contact between the fabric articles 48 and dry cleaning solvent so that the soil and other contaminants are more quickly separated from the fabric articles 48. In an exemplary embodiment, using a dry cleaning system 10 such as that described above and shown in FIGS. 1 and 2, fabric articles 48 (see, e.g., FIGS. 5 and 6) are placed in the chamber 16 of the drum 12 through the opening 24, and then the door 26 is closed. Dry cleaning solvent (not shown) is then provided to the chamber 16 and the drum 12 is rotated for one or more washing time intervals. As indicated in FIG. 3, a draining cycle 120 may be performed after the washing cycle 110, when the fabric articles 48 are believed to be sufficiently cleaned. More particularly, the draining cycle 120 is performed by opening the valve 34 and allowing gravitational forces to cause the majority (e.g., such as at least 60%, or at least 75%, or even at least 85%) of the dry cleaning solvent to drain from the chamber 16 and fluid zone 22, through the liquid outlet 32 of the housing 18. The drum 12 may be rotated during the draining cycle 120 as well to encourage separation of liquid dry cleaning solvent from the fabric articles 48 in the chamber 16. As will be understood by persons of ordinary skill in the relevant art, it is not required that the draining cycle 120 be a distinct and separate cycle from the washing cycle 110 and it also need not be performed immediately after a washing cycle 110. For instance, the draining cycle 120 can be performed as part of the washing cycle 110. Optionally, the washing and draining cycles 110, 120 may overlap or be performed consecutively or concurrently. Additionally, the washing cycle 110 may include or be followed by one or more optional rinsing cycles wherein spent dry cleaning solvent is allowed to drain from the drum 12, followed by providing fresh dry cleaning or another type of solvent, with or without rotation of the drum 12, followed again by draining the most recently added dry cleaning or other solvent from the drum 12.

In one embodiment, following the washing cycle 110 and any draining cycle 120 or rinsing cycles (not shown), heated air is added (see block 130 in FIG. 3) via the inlet passage 36 to the chamber 16 to contact and heat the washed fabric articles 48 and dry cleaning solvent therein for a heating time period. In accordance with the method of the present invention, as shown schematically by arrows A1 and A2 in FIG. 5, the heated air is injected into the chamber 16 at one end of the drum 12 (e.g., a first end 42 proximate to where the door 26 sealably covers the opening 24 of the drum 12 and housing 18). As mentioned above, the air may be provided to the chamber 16 using a fan or impeller 38 and may be heated before entering the chamber 16 using a heater 40 positioned in the inlet passage 36.

The extracting/drying cycle 140 is performed for at least a portion of the heating time period 130 during which the heated air is provided to the chamber 16. That is, the extracting/drying cycle 140 is performed while heated air is supplied to the chamber 16. More particularly, with reference to FIGS. 3 and. 4, the extracting/drying cycle 140 includes at least one high spin period 144 (see, e.g., high spin period 144 of FIG. 4). During the high spin period 144, the drum 12 is rotated at a high speed, such as from about 350 to about 1200 revolutions per minute (rpm), or from about 350 to about 400 rpm (e.g., for hard mounted dry cleaning machines), or even from about 800 to about 1200 rpm, and for a predetermined high spin period of time, such as from about 0.5 to about 10 minutes (min), or even from about 0.5 to about 5 min. For example, centrifugal forces created by rotating the drum 12 at high speed during the high spin period 144 (see arrows labeled "F" in FIGS. 5 and 6) drive a major portion (e.g., at least about 80%, or at least about 90%, or even at least about 95%) of the liquid phase dry cleaning solvent that remains after washing and draining cycles 110, 120 out of the chamber 16, away from the fabric articles 48 and into the fluid zone 22 (as indicated by the solid arrows L in FIG. 6). From the fluid zone 22, the separated liquid phase dry cleaning solvent exits the housing 18 via the liquid outlet 32.

Figure 5:
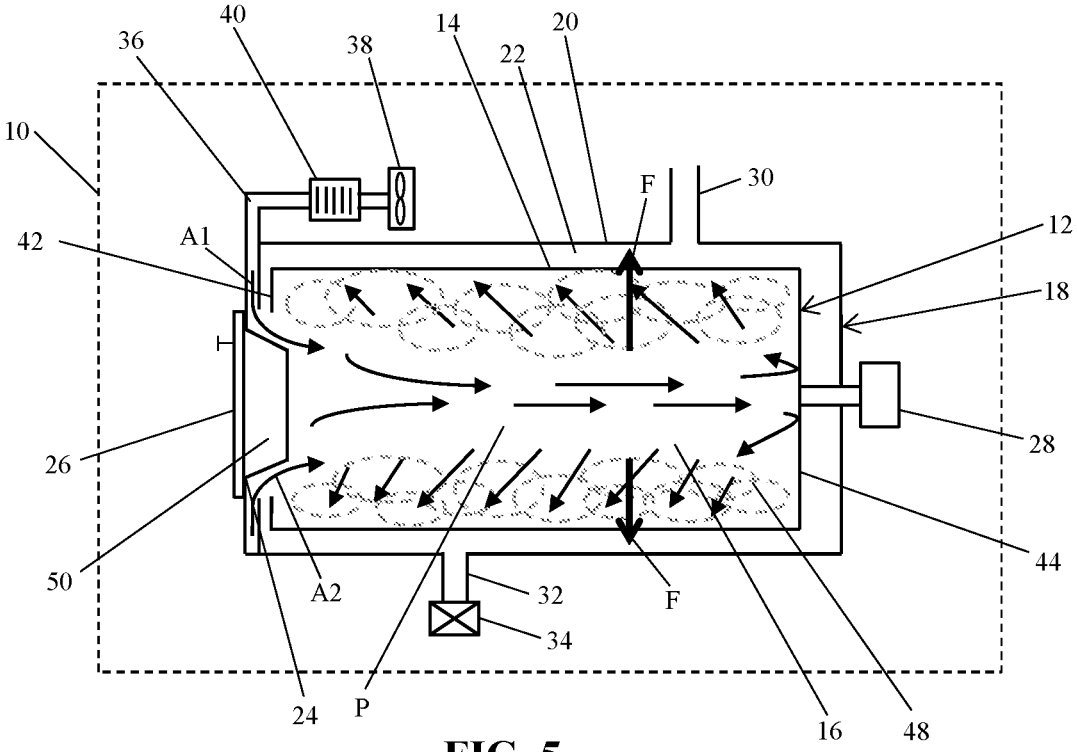
FIG. 5 is the schematic side view of the dry cleaning system of FIG. 1 showing the flow of fluids therein.
Figure 6:
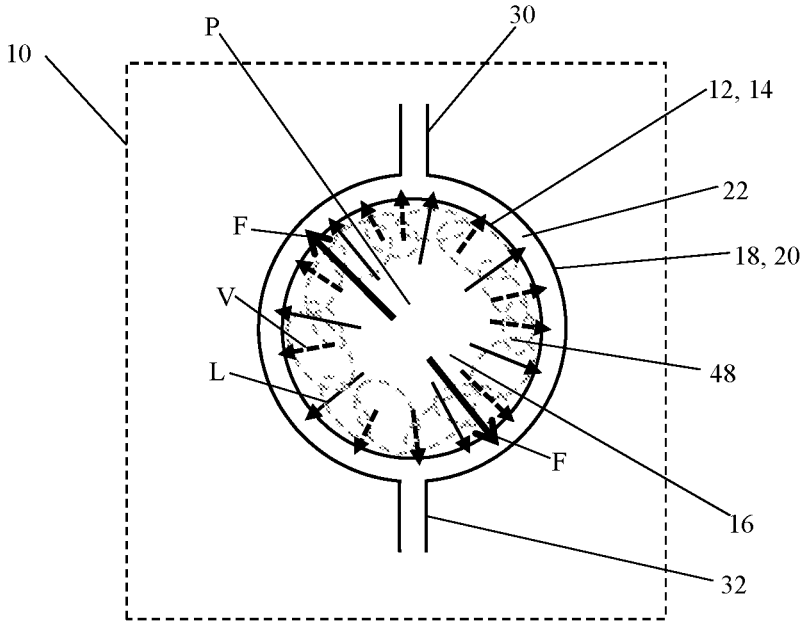
FIG. 6 is the schematic end view of the rotatable cylindrical drum and housing of FIG. 2 showing the flow of fluids therein.

Additionally, with reference to FIGS. 5 and 6, the centrifugal forces F created during the high spin period 144 force the fabric articles 48 in the chamber 16 toward the wall 14, thereby creating an unobstructed central pathway P through which the heated air (see solid arrows in the chamber 16 in FIG. 5) flows from the end 42 toward the opposite end (e.g., a second end 44) of the drum 12. More particularly, the air is injected into the chamber 16 at the end 42 though the inlet passage 36 in a vertical direction, is defected by a deflector member 50 mounted on the door 26 at the end 42 and flows in a horizontal direction parallel to and/or along a longitudinal axis of the drum 12 through the unobstructed pathway P toward the opposite end 44 of the drum 12. Upon reaching the opposite end 44 of the drum 12, the air is deflected and flows in a generally reverse direction, back into the chamber 16 such that the heated air is distributed throughout the chamber 16. Furthermore, the centrifugal forces F also cause the heated air to flow radially outward toward and through the wall 14 of the chamber 16 and hence also through the fabric articles 48, as indicated by the dashed arrows V in FIG. 6. Thus, the centrifugal forces cause the heated air to flow in a radially outward direction from the interior (e.g., the chamber 16) of the drum 12 to the exterior of the drum 12 (e.g., into the fluid zone 22). As the heated air passes through the fabric articles 48, the heated air contacts and heats the residual dry cleaning solvent on the fabric articles 48 and causes at least a portion of the residual dry cleaning solvent to evaporate and be removed therefrom through the perforations (not shown) and into the fluid zone 22, as shown schematically by the dashed arrows V in the chamber 16 in FIG. 6. Air and vapor phase dry cleaning solvent thus driven from the chamber 16 exit the fluid zone 22 together via the vapor outlet 30 of the housing 18. A cooling coil (not shown) or other mechanism may be associated with the vapor outlet 30 to capture and collect the vapor phase dry cleaning solvent.

As discussed above, a major portion of the liquid phase dry cleaning solvent is separated and removed from the fabric articles 48 and the chamber 16 by centrifugal forces created during the high spin period 144, while the same centrifugal forces increase contact between the heated air and the fabric articles 48 (as the heated air is forced to move radially outward through the fabric articles 48) which causes additional dry cleaning solvent to evaporate, whereupon it is more easily separated from the fabric articles 48 and removed from the chamber 16. In addition, it is believed that heating the fabric articles 48 and liquid phase dry cleaning solvent decreases the attractive forces between them and thereby facilitates separation of additional quantities of liquid phase dry cleaning solvent from the fabric articles. Without being bound by theory, even when the fabric articles 48 and liquid phase dry cleaning solvent are heated to a temperature below the boiling point of the dry cleaning solvent, the attractive forces between the fabric articles and dry cleaning solvent are decreased, thereby facilitating their separation and increasing the amount of liquid phase dry cleaning solvent that can be extracted during the extracting/drying cycle 140. Thus, the dry cleaning method 100 of the present invention provides enhanced and efficient removal of the dry cleaning solvent from fabric articles that have been subjected to dry cleaning washing and draining cycles 110, 120 (e.g., through simultaneous removal of the dry cleaning solvent in gas and liquid phases).

Returning to FIG. 4, in an exemplary embodiment of the method of the present invention, the extracting/drying cycle 140 may also include one or more tumble spin periods which are performed alternately with one or more high spin periods. During a tumble spin period 142, 146, the drum 12 is rotated at a tumbling speed, such as from about 10 to about 20 rpm, and for a tumbling period of time, such as from about 0.25 to about 15 min, or from about 0.25 to about 10 min, or from about 0.25 to about 5 min, or even from about 0.25 to about 2 min. During a tumble spin period (e.g., the tumble spin periods 142, 146 in FIG. 4) of the extracting/drying cycle 140, rotation of the drum 12 is slow enough to allow gravitational forces to act on the fabric articles 48 to pull them away from the wall 14 of the drum 12 and cause them to tumble and rearrange. When tumbling in this manner, the fabric articles 48 and residual dry cleaning solvent thereon are more easily and thoroughly contacted by the heated air. Moreover, such tumbling enhances extraction and drying (i.e., separation of the dry cleaning solvent from the fabric articles 48) during subsequent cycles, such as for example, subsequently performed high spin periods, as will now be described in further detail.

Figure 4:
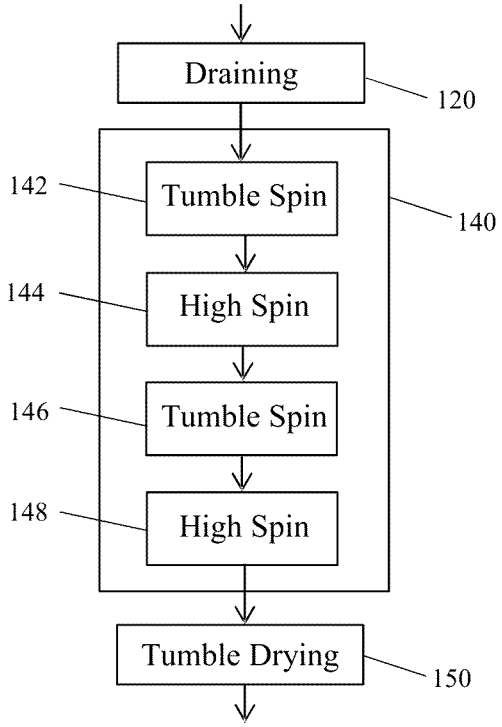
FIG. 4 is a flow chart illustrating an exemplary embodiment of the extract/dry cycle of the dry cleaning method illustrated in FIG. 3.

Performing the extracting/drying cycle 140 by using alternating high spin and tumble spin periods 142, 144, 146, 148 as illustrated in FIG. 4 is believed to increase the amount of dry cleaning solvent separated and removed from the fabric articles 48 in a shorter period of time. More particularly, performing a first tumble spin period 142 redistributes the fabric articles 48 in the chamber 16 so that they are more efficiently contacted with the heated air being provided to the chamber 16 which increases the amount of dry cleaning solvent separated and removed by the subsequent high spin period 144. Since first high spin period 144 is likely to press the fabric articles 48 tightly against the wall 14 of the chamber 16 which at least partially prevents the heated air from continuing to efficiently contact the fabric articles 48, a second tumble spin period 146 is performed to allow gravity to act on the fabric articles 48 and pull them away from the wall 14, thus again redistributing the fabric articles 48 in preparation for continued contact with heated air and performance of a second high spin period 148 which causes additional liquid and vapor phase dry cleaning solvent to be separated simultaneously from the fabric articles 48 and forced from the chamber 16 and out of the housing 18 through the vapor and liquid outlets 30, 32, respectively, as described above. Optionally, the entire above described extracting/drying cycle 140 which includes a first tumble spin period 142, followed by a first high spin period 144, then a second tumble spin period 146 and a second high spin period 148, may be repeated one or more times, as desired, before moving on to subsequent cycles. Alternatively, one or more of the tumble or high spin periods 142, 144, 146, 148 may be repeated or omitted (e.g., only the first tumble and high spin periods 142, 144 may be performed).

In one exemplary embodiment, heated air is supplied throughout the performance of the entire extraction/drying cycle 140. In other exemplary embodiments, the heated air is supplied for a portion of the time period during which the extraction/drying cycle 140 is performed. The temperature of the heated air may be within conventionally acceptable ranges. In one embodiment, the heated air temperature may be from about 70 to about 200 degrees Fahrenheit (° F.). As will be understood and determinable by persons of ordinary skill in the relevant art, the temperature desired for the heated air may depend on the particular type of dry cleaning solvent used and may be above or below the boiling point temperature of the dry cleaning solvent used.

Figure 3:
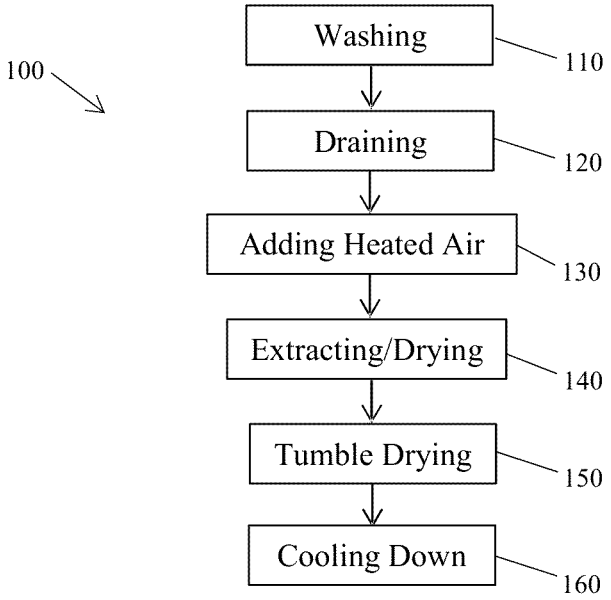
FIG. 3 is a flow chart illustrating an exemplary embodiment of the dry cleaning method of the present invention.

As illustrated in FIG. 3, after performance of the extracting/drying cycle 140, a tumble drying cycle 150 may be performed during which the drum 12 is rotated at a tumble speed, such as from about 10 to about 20 rpm, and for a tumble drying period of time, such as from about 0.5 to about 5 min. Similar to the tumble spin period (142, 146) described above, the tumble drying cycle 150 is a cycle in which the rotation of the drum 12 is slow enough to allow gravitational forces to act on the fabric articles, causing them to tumble and rearrange and be more efficiently contacted by the heated air in the chamber 16. In some embodiments of the dry cleaning method 100 of the present invention, heated air may continue to be provided to the drum 12 and chamber 16 during the tumble drying cycle 150 (i.e., the tumble drying cycle 150 may be performed for at least a portion of the heating time period 130 during which the heated air is provided to the chamber 16).

As also illustrated in FIG. 3, in an exemplary embodiment, the tumble drying cycle 150 may be followed by a cooling down cycle 160 in which no heated air is added to the chamber, but rotation of the drum 12 may be continued. Typically, during the cooling down cycle 160, the drum 12 will continue to be rotated at about a tumble speed, such as from about 10 to about 20 rpm, for a cooling period of time, such as from about 0.5 to about 5 min. In some embodiments, room temperature air or even cooled air may be provided to the chamber 16 during the cooling down cycle 160 to speed cooling of the fabric articles to permit handling.

While exemplary embodiments have been presented in the foregoing detailed description, it should be appreciated that various additional embodiments and modification are possible that remain within the intent and function of the invention described and contemplated herein. For example, the extracting/drying cycle 140 of the dry cleaning method 100 described and contemplated herein may include other types of spin periods, such as, without limitation, a low spin segment or even a ramp down spin cycle. During a useful "low spin period," for example, the drum 12 might be rotated at a low spin speed of from about 30 to about 60 rpm for a low spin period of from about 0.5 to 3 min. A "ramp down spin period" would be, for example, a transition period between other spin periods during which, for example without limitation, the speed of rotation of the drum 12 is gradually decreased, such as from the speed of an immediately preceding spin period (e.g., a high spin period) to the speed of an immediately subsequent spin period (e.g., the speed of a tumble spin period). For example without limitation, a ramp down period may be performed for a ramp down time period of from about 0.25 to about 2 min. Thus, while the extracting/drying cycle 140 of the present dry cleaning method includes at least one high spin period, it may also include one or more other alternating periods chosen from: one or more tumble spin periods, one or more low spin periods, one or more ramp down spin periods, or other spin periods as will be recognized and determinable by persons of ordinary skill in the relevant art. Furthermore, in some embodiments, heated gas may also be supplied to the drum during all or a portion of time during which any one or more types of spin periods are performed, including during one or more high spin, low spin, tumble spin or ramp down periods, or any combination thereof. Additionally, in some embodiments of the dry cleaning method 100 of the present invention, the extracting/drying cycle 140 may include performing more than one high spin period (e.g., rotation of the drum 12 at a rotational speed such that fabric articles 48 within the drum 12 are pressed and held against the wall 14 of the drum 12 by centrifugal forces while simultaneously causing heated gas to flow radially outward), with or without other types of spin periods performed therebetween. Still further, some embodiments may comprise repeating the extraction/drying cycle 140 one or more times, such as up to 5, 10 or even 15 times, before continuing the method by performing the tumble drying and cool down cycles 150, 160. Alternatively, the tumble drying and/or cool down cycles 150, 160 may be omitted.

It should also be appreciated that the exemplary embodiment or embodiments are merely examples, and are not intended to limit the scope, applicability, or configuration of the invention in any way. The foregoing detailed description provides those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

I claim:

1. A method for cleaning fabric articles, said method comprising the steps of: washing the fabric articles with a cleaning solvent in a rotatable drum having opposite axial ends and a wall; and drying the washed fabric articles in the drum, said drying step including the steps of rotating the drum at a spin speed for a spin period of time such that the fabric articles move toward the wall of the drum so as to cause removal from the fabric articles of at least a portion of the cleaning solvent remaining in the fabric articles and so as to form an unobstructed pathway extending between the axial ends of the drum; and providing a heated gas into the drum from an inlet located adjacent one of the ends of the drum during the spin period, the heated gas being injected into the drum from the inlet in a vertical direction and being directed by a deflector in a horizontal direction along a longitudinal axis of the drum such that the heated gas flows from the one of the ends of the drum through the pathway toward the other of the ends of the drum, at least some of the heated gas flowing directly to the other of the ends through the pathway such that the heated gas is distributed along the entire length of the drum, the heated gas flowing radially outwardly from an interior of the drum to an exterior of the drum through the fabric articles so as to cause at least another portion of the cleaning solvent remaining in the fabric articles to evaporate and be removed therefrom.

2. The method of claim 1, wherein at least some of the cleaning solvent is removed from the fabric articles in both liquid and vapor phases during the performance of said drying step.

3. The method of claim 2, wherein heat in the fabric articles decreases attractive forces between the liquid phase cleaning solvent and the fabric articles, facilitating the separation and hence removal of at least some of the liquid phase cleaning solvent from the fabric articles.

4. The method of claim 1, wherein the rotation of the drum at the spin speed creates centrifugal forces causing the fabric articles to be radially pressed against a wall of the drum during the rotation of the drum, causing at least a first portion of the liquid phase cleaning solvent in the fabric articles to flow in a radially outward direction from an interior of the drum to an exterior of the drum.

5. The method of claim 4, wherein the centrifugal forces cause the heated gas to flow in the radially outward direction through the fabric articles from the interior of the drum to the exterior of the drum, causing at least a second portion of the liquid phase cleaning solvent in the fabric articles to evaporate into vapors, the centrifugal forces causing the vapors to flow in the radially outward direction from the fabric articles to the exterior of the drum together with the at least a first portion of the liquid phase cleaning solvent.

6. The method of claim 1, wherein the heated air has a temperature within a range from about 70 degrees Fahrenheit to about 200 degrees Fahrenheit.

7. The method of claim 1, wherein the spin speed is within a range from about 350 revolutions per minute to about 1200 revolutions per minute.

8. The method of claim 7, wherein the spin period of time is within a range from about 0.5 minute to about 10 minutes.

9. The method of claim 1, wherein said drying step includes the step of performing a tumble spin period by rotating the drum at a tumbling speed for a tumble period of time, either before or after the performance of said rotating step, or both before and after the performance of said rotating step.

10. The method of claim 9, wherein the tumbling speed is within a range from about 10 rotations per minute to about 20 rotations per minute; and the tumble period of time is within a range from about 0.25 minute to about 15 minutes.

11. The method of claim 9, wherein said tumble spin period is performed after the performance of said rotating step, said drying step further comprising the steps of: performing a second rotation period by rotating the drum at a second spin speed for a second spin period of time after the performance of the tumble spin period; and providing a second heated gas into the drum from the inlet during the performance of said second spin period.

12. The method of claim 9, wherein the tumble spin period is performed before and after the performance of said rotating step, said drying step further comprising the steps of performing a second rotation period by rotating the drum at a second spin speed for a second spin period of time after the performance of the tumble spin period; providing a second heated gas into the drum from the inlet during the performance of said second spin period; and performing another tumble spin period after the performance of said second spin period.

13. The method of claim 1, further comprising the step of performing a second spin period by rotating the drum at a second spin speed, which is lower than the spin speed of the spin period, for a second spin period of time, after the performance of said washing step, and before or after the performance of said rotating step, or both before and after the performance of said rotating step.

14. The method of claim 1, wherein the cleaning solvent comprises an aqueous solvent or a non-aqueous dry cleaning solvent.

15. The method of claim 1, wherein the deflector is mounted to a door attached adjacent the one of the ends of the drum.

* * * * *